US010186195B2

(12) United States Patent
Yang et al.

(10) Patent No.: US 10,186,195 B2
(45) Date of Patent: Jan. 22, 2019

(54) ORGANIC LIGHT EMITTING DISPLAY DEVICE AND DRIVING METHOD THEREOF

(71) Applicant: SAMSUNG DISPLAY CO., LTD., Yongin-si, Gyeonggi-do (KR)

(72) Inventors: Jin Wook Yang, Yongin-si (KR); Young Wook Yoo, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 207 days.

(21) Appl. No.: 15/013,892

(22) Filed: Feb. 2, 2016

(65) Prior Publication Data

US 2016/0293109 A1 Oct. 6, 2016

(30) Foreign Application Priority Data

Apr. 3, 2015 (KR) ..... 10-2015-0047634

(51) Int. Cl.
*G09G 3/3241* (2016.01)
*G09G 3/3233* (2016.01)

(52) U.S. Cl.
CPC ... *G09G 3/3233* (2013.01); *G09G 2320/0295* (2013.01); *G09G 2320/045* (2013.01)

(58) Field of Classification Search
CPC ... G09G 3/2007; G09G 3/3241; G09G 3/3283
USPC ..... 345/76, 87, 212, 690
See application file for complete search history.

(56) References Cited

U.S. PATENT DOCUMENTS

2008/0042943 A1* 2/2008 Cok ..... G09G 3/3225 345/77
2009/0160740 A1* 6/2009 Leon ..... G09G 3/3291 345/76
2010/0225634 A1* 9/2010 Levey ..... G09G 3/3208 345/212
2011/0227505 A1 9/2011 Park et al.
2013/0147693 A1 6/2013 Bae
2014/0035488 A1 2/2014 Nathan et al.

FOREIGN PATENT DOCUMENTS

KR 10-2009-0063207 A 6/2009
KR 10-2011-0104705 A 9/2011
KR 10-2013-0064552 A 6/2013

* cited by examiner

*Primary Examiner* — Calvin C Ma
(74) *Attorney, Agent, or Firm* — Lewis Roca Rothgerber Christie LLP

(57) ABSTRACT

There are provided an organic light emitting display device capable of enhancing display quality. The organic light emitting display device includes a compensation unit configured to extract current information of an organic light emitting diode (OLED) of a pixel, and configured to determine a brightness compensation amount corresponding to the extracted current information, and a timing controller configured to generate second data by changing bits of externally supplied first data according to the brightness compensation amount, wherein the compensation unit is configured to obtain the brightness compensation amount using a current variation corresponding to a degradation of the OLED, and using a linear function corresponding to the current variation.

19 Claims, 7 Drawing Sheets

| | | | | | |
|---|---|---|---|---|---|
| 0.7% | 14.5% | 3.5% | 9.2% | 1.2% | 9.0% |
| 4.1% | 0.1% | 8.6% | 8.2% | 12.4% | 5.6% |
| 14.4% | 12.3% | 4.9% | 14.3% | 7.7% | 1.2% |
| 8.5% | 3.9% | 10.5% | 7.6% | 8.5% | 0.4% |
| 5.8% | 11.4% | 2.3% | 3.8% | 15.0% | 1.9% |
| 14.0% | 5.2% | 12.7% | 12.7% | 6.7% | 3.7% |

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2015-0047634, filed on Apr. 3, 2015, in the Korean Intellectual Property Office, the entire contents of which are incorporated herein by reference in their entirety.

BACKGROUND

1. Field

Embodiments of the present invention relate to an organic light emitting display device and a driving method thereof, and more particularly, to an organic light emitting display device, and a driving method thereof capable of enhancing display quality.

2. Description of the Related Art

Recently, various flat panel display devices having reduced weight and size, which are shortcomings of cathode ray tubes (CRTs), have been developed. Flat panel display devices include a liquid crystal display (LCD), a field emission display (FED), a plasma display panel (PDP), and an organic light emitting display device.

Among the flat panel display devices, the organic light emitting display device displays an image using an organic light emitting diode (OLED), which generates light according to recombination of electrons and holes, and having aspects of fast response speed and low power consumption.

The organic light emitting display device includes a plurality of pixels respectively positioned in regions defined by a plurality of data lines and scan lines. Generally, the pixels each include an OLED, two more transistors including a driving transistor, and one or more capacitors.

An OLED included in each pixel may degrade over the passage of time, resulting in a failure of displaying an image with desired brightness. Thus, a method for compensating for a degraded OLED may improve display quality.

SUMMARY

An embodiment of the present invention relates to an organic light emitting display device and a driving method thereof capable of enhancing display quality.

An organic light emitting display device according to an embodiment of the present invention includes a compensation unit configured to extract current information of an organic light emitting diode (OLED) of a pixel, and configured to determine a brightness compensation amount corresponding to the extracted current information, and a timing controller configured to generate second data by changing bits of externally supplied first data according to the brightness compensation amount, wherein the compensation unit is configured to obtain the brightness compensation amount using a current variation corresponding to a degradation of the OLED, and using a linear function corresponding to the current variation.

The linear function may correspond to the equation:

$$\Delta L=\alpha\Delta I+\beta,$$

wherein α and β denote respective constant values of the linear function, wherein ΔI denotes the current variation, and wherein ΔL denotes the brightness variation.

The compensation unit may include a current measurement unit configured to obtain the current variation ΔI, a storage unit configured to store the linear function and information corresponding to the brightness compensation amount, and a calculation unit configured to obtain the brightness compensation amount.

The current measurement unit may be further configured to supply a reference voltage to the OLED, and may be further configured to obtain the current variation ΔI by comparing an amount of current flowing in the OLED in response to the reference voltage with a reference current value corresponding to when the OLED is not degraded.

The calculation unit may be further configured to obtain the brightness variation ΔL according to the current variation ΔI, and may be further configured to obtain the brightness compensation amount by using the equation:

$$\Delta T=1/(1-\Delta L),$$

wherein ΔT denotes the brightness compensation amount.

The calculation unit may be configured to set β to 0 when the current variation ΔI is 0.

The calculation unit may be configured to set the brightness compensation amount ΔT to 1 when the brightness variation ΔL is less than 0, or when the brightness variation ΔL is equal to or greater than 1.

The timing controller may include a data compensating unit configured to generate the second data by multiplying the first data by the brightness compensation amount.

The timing controller may further include a data limiting unit configured to reduce bits of the first data when corresponding bits of the second data exceed an area expressed by gray levels.

The data compensating unit may be configured to generate the second data by reflecting a gamma value in the brightness compensation amount when the organic light emitting display device is driven according to an analog scheme.

A method of driving an organic light emitting display device according to an embodiment of the present invention includes determining a current variation corresponding to a degradation of an organic light emitting diode (OLED), obtaining a brightness compensation amount of the OLED using a linear function of a brightness variation of the OLED corresponding to the current variation, and generating second data by changing bits of externally supplied first data according to the brightness compensation amount.

The determining of the current variation may include supplying a reference voltage to the OLED, measuring a current flowing to the OLED, and determining the current variation by comparing the current with a reference current value, the reference current value corresponding to when the OLED is not degraded.

The linear function may correspond to the equation:

$$\Delta L=\alpha\Delta I+\beta$$

wherein α and β denote respective constant values of the linear function, wherein ΔI denotes the current variation, and wherein ΔL denotes the brightness variation.

The brightness compensation amount may correspond to the equation:

$$\Delta T=1/(1-\Delta L)$$

wherein ΔT denotes the brightness compensation amount.

The method may further include setting β to 0 when the current variation ΔI is set to 0.

The method may further include setting the brightness compensation amount ΔT to 1 when the brightness variation ΔL is less than 0 or when the brightness variation ΔL is equal to or greater than 1.

The method may further include generating the second data by multiplying the first data by the brightness compensation amount.

The method may further include generating the second data by additionally reflecting a gamma value in the brightness compensation amount when the organic light emitting display device is driven according to an analog scheme.

The method may further include reducing bits of the first data when corresponding bits of the second data exceed an area represented by gray levels.

According to the organic light emitting display device and the driving method thereof of embodiments of the present invention, a current amount flowing to the OLED and a brightness variation may be modeled by a linear function, and a degradation of the OLED may be compensated by using the linear function. That is, in the present invention, a degradation of the OLED may be compensated, and thus, an image having uniform brightness may be displayed.

DETAILED DESCRIPTION

Figure 1:
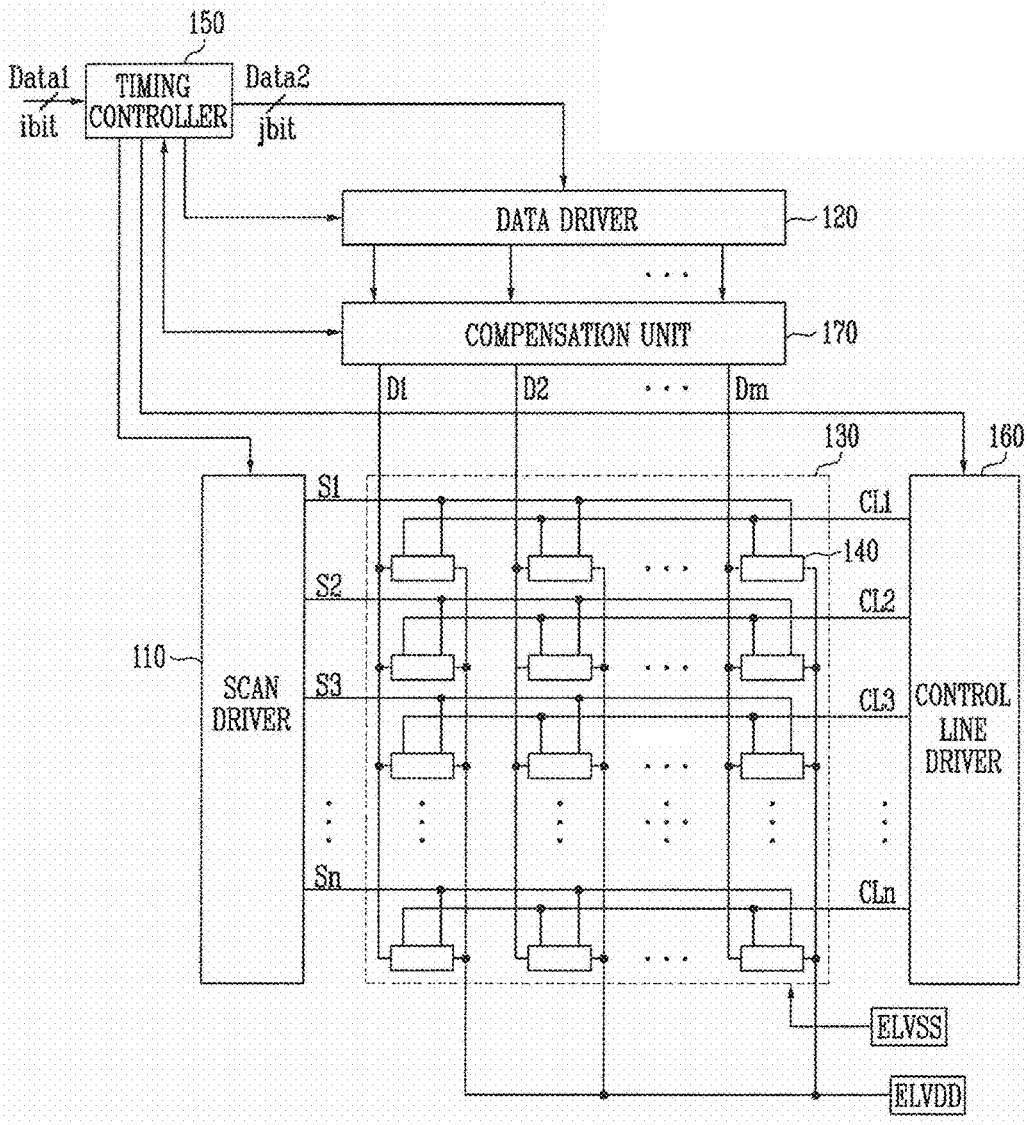
FIG. 1 is a view illustrating an organic light emitting display device according to an embodiment.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a view illustrating an organic light emitting display device according to an embodiment.

Referring to FIG. 1, an organic light emitting display device according to an embodiment of the present invention includes a display area (e.g., a pixel part) 130 including pixels 140 positioned in respective regions demarcated by scan lines S1 to Sn and data lines D1 to Dm, a scan driver 110 for driving the scan lines S1 to Sn, and a control line driver 160 for driving control lines CL1 to CLn. The organic light emitting display device further includes a data driver 120 for supplying respective data signals to the data lines D1 to Dm, a compensation unit 170 for extracting current information of OLEDs from the pixels 140, and a timing controller 150 for controlling the drivers 110, 120, and 160, and the compensation unit 170.

The display area 130 includes the pixels 140 positioned in regions demarcated by the scan lines S1 to Sn, the data lines D1 to Dm, and the control lines CL1 to CLn. The pixels 140 receive a first power ELVDD and second power ELVSS, which may be externally supplied. When a data signal corresponding to analog driving is supplied, the pixels 140 receiving the data signal control an amount of current supplied from the first power ELVDD to the second power ELVSS by way of their respective OLEDs. Also, when a data signal corresponding to digital driving is supplied, the pixels 140 control an electrical connection time between the OLEDs and the first power ELVDD.

The scan driver 110 is configured to supply a scan signal to the scan lines S1 to Sn under the control of the timing controller 150. For example, the scan driver 110 may sequentially supply the scan signal to the scan lines S1 to Sn under the control of the timing controller 150. Here, the scan signal refers to a voltage by which transistors coupled to the scan lines S1 to Sn, and included in the pixels 140, are turned on.

The control line driver 160 is configured to supply a control signal to the control lines CL1 to CLn under the control of the timing controller 150. For example, the control line driver 160 may sequentially supply a control signal to the control lines CL1 to CLn during a sensing period wherein current information of the OLED is extracted from the pixels 140. Here, the control signal refers to a voltage by which the transistors coupled to the control lines CL1 to CLn, and included in the pixels 140, are turned on.

The data driver 120 is configured to generate data signals using second data Data2 supplied from the timing controller 150, and is configured to respectively supply the generated data signals to the data lines D1 to Dm. Here, when driven according to an analog scheme, the data signals may be set to have voltage values corresponding to gray levels (for example, a gray level of 256) that are intended to be represented. Also, when driven according to a digital scheme, the data signals may be set to have voltage values corresponding to "ON" or "OFF" for operation of the driving transistors.

The compensation unit 170 extracts current information of OLEDs of the pixels 140. For example, the compensation unit 170 may extract current values of the OLEDs included in the pixels 140 during a sensing period in which the control signal is sequentially supplied to the control lines CL1 to CLn. Details regarding the compensation unit 170, the control lines CL1 to CLn, and the sensing period will be described hereinafter. In addition, the compensation unit 170 may control the data lines D1 to Dm to be connected to the data driver 120 during a driving period in which an image may be displayed in the display area 130.

The timing controller 150 is configured to control the scan driver 110, the data driver 120, the control line driver 160, and the compensation unit 170. Also, in response to a "brightness compensation amount" supplied from the compensation unit 170, the timing controller 150 converts a bit value of the first data Data1 to generate second data Data2. Here, the second data Data2 is set to compensate a degradation of OLEDs included in the pixels 140. The first data Data1 may be set to "i" bits (i is a natural number), and the second data Data2 may be set to "j" bits (j is a natural number that may be equal to or greater than i).

In the embodiment shown in FIG. 1, the compensation unit 170 and the timing controller 150 are separated, but the present invention is not limited thereto. For example, the compensation unit 170 may be included in the timing controller 150.

Figure 2:
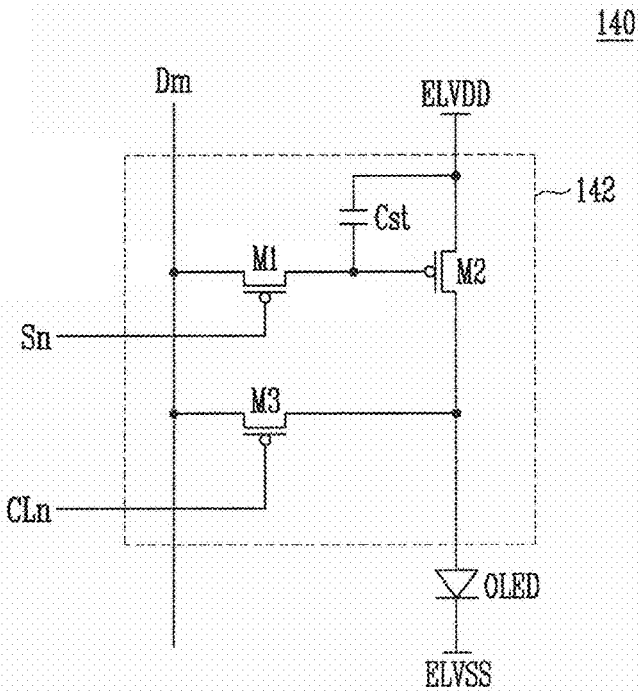
FIG. 2 is a view illustrating a pixel according to an embodiment.

FIG. 2 is a view illustrating a pixel according to an embodiment. In FIG. 2, a pixel connected to the $n^{th}$ scan line Sn and $m^{th}$ data line Dm is illustrated for the purpose of description.

Referring to FIG. 2, the pixel 140 according to an embodiment of the present invention includes an OLED and a pixel circuit 142 for supplying a current to the OLED.

An anode electrode of the OLED is connected to the pixel circuit 142, and a cathode electrode of the OLED is connected to the second power ELVSS. The OLED generates light having brightness in response to a corresponding current supplied to the OLED from the pixel circuit 142.

The pixel circuit 140 controls an amount of current, or controls a current supply time, to generate light corresponding to a data signal during a driving period. The pixel circuit 142 supplies current information of the OLED to the compensation unit 170 during a sensing period. To this end, the pixel circuit 142 includes three transistors M1 to M3, and a storage capacitor Cst.

A gate electrode of the first transistor M1 is connected to the scan line Sn, and a first electrode of the first transistor M1 is connected to the data line Dm. A second electrode of the first transistor M1 is connected to a gate electrode of the second transistor M2. The first transistor M1 is turned on when a scan signal is supplied to the scan line Sn. Here, the first electrode may be any one of a source electrode or a drain electrode, and the second electrode may be the other (i.e., different from the first electrode).

A gate electrode of the second transistor M2 (i.e., a driving transistor) is connected to the second electrode of the first transistor M1, and a first electrode of the second transistor M2 is connected to the first power ELVDD. A second electrode of the second transistor M2 is connected to an anode electrode of the OLED. The second transistor M2 may be driven according to a voltage applied to the gate electrode of the second transistor M2, namely, according to a voltage stored in the storage capacitor Cst.

A gate electrode of the third transistor M3 is connected to the control line CLn, and a second electrode of the third transistor M3 is connected to an anode electrode of the OLED. Also, a first electrode of the third transistor M3 is connected to the data line Dm. The third transistor M3 is configured to be turned on when a control signal is supplied to the control line CLn, and to be turned off otherwise.

The storage capacitor Cst is connected between the gate electrode of the second transistor M2 and the first power ELVDD. The storage capacitor Cst stores a voltage corresponding to a data signal.

Referring to an operation process, in response to a scan signal supplied to the scan line Sn during a driving period, the first transistor M1 is turned on. When the first transistor M1 is turned on, a data signal from the data line Dm is stored in the storage capacitor Cst.

When analog driving is used to drive the pixel 140, the second transistor M2 controls an amount of current flowing to the OLED according to a voltage stored in the storage capacitor Cst. When digital driving is used, the second transistor M2 is turned on or turned off according to the voltage stored in the storage capacitor Cst. That is, when the pixel 140 is driven according to a digital driving scheme, gray levels are represented according to a turn-on period of the second transistor M2.

During a sensing period, a control signal is sequentially supplied to the control lines CL1 to CLn. When the control signal is supplied to the control line CLn, the third transistor M3 is turned on. When the third transistor M3 is turned on, a reference voltage from the compensation unit 170 is supplied to the anode electrode of the OLED. Here, a set current (e.g., a predetermined current) corresponding to the reference voltage flows in the OLED, and the current is supplied as degradation information to the compensation unit 170.

In detail, an amount of current flowing in the OLED according to the reference voltage is changed according to, or depends on, an extent of degradation of the OLED. For example, a resistance value of the OLED increases according to the degradation, and thus, the amount of flowing current corresponding to the reference voltage is changed according to the degradation. Thus, degradation information of the OLED may be determined by using a variation of the current of the OLED corresponding to the reference voltage.

Meanwhile, the structure of the pixel 140 of the embodiments of the present invention is not limited to that illustrated in FIG. 2. In actuality, the pixel 140 of the present invention may be variously modified to another structure including the third transistor M3 such that current information of the OLED is extracted.

Figure 3:
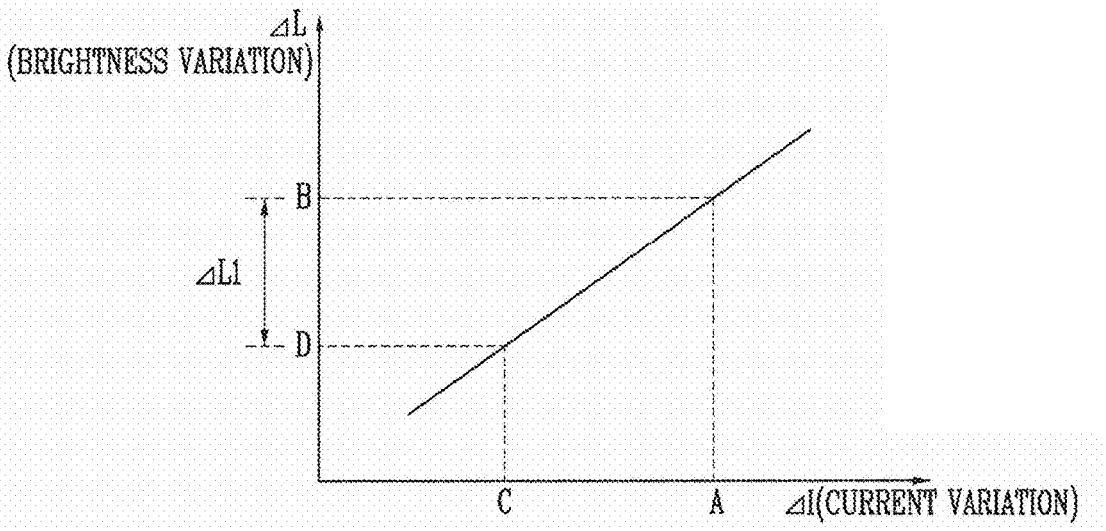
FIG. 3 is a graph illustrating a compensation principle of an organic light emitting diode (OLED) according to an embodiment.

FIG. 3 is a graph illustrating a compensation principle of an OLED according to an embodiment. In FIG. 3, the X axis represents current variation ΔI corresponding to a degradation of the OLED, and the Y axis represents brightness variation ΔL corresponding to the current variation ΔI.

When the OLED is degraded, the current corresponding to the reference voltage is lowered from "A" to "C," and brightness of the OLED is lowered from "B" to "D" according to the degradation. Thus, when the current of the OLED according to the reference voltage is lowered from "A" to "C," an image having desired brightness may be implemented by increasing brightness of the OLED by a first brightness difference ΔL1. In the present embodiment, brightness resulting from the degradation of the OLED is increased by changing bits of the data Data (e.g., by changing the Data from Data 1 to Data 2).

Meanwhile, a current flowing in the OLED according to the reference voltage during a sensing period is not equal to a current that flows during an actual driving period. Thus, a reduction in current corresponding to the degradation of the OLED cannot be accurately determined based on only the current flowing in the OLED corresponding to the reference voltage.

Thus, in the present invention, a relational expression of the brightness variation ΔL to the current variation ΔI of the OLED is obtained and modeled by a linear function. For example, the graph of FIG. 3 may be modeled by a linear function as expressed by Equation (1) below.

$$\Delta L=\alpha\Delta I+\beta \tag{1}$$

In Equation (1), α and β refer to respective constant values of the linear function. Also, ΔI denotes a current variation, and ΔL denotes a brightness variation (brightness decrement).

In Equation (1), when the brightness variation ΔL is obtained, a brightness compensation amount ΔT may be obtained by using Equation (2).

$$\Delta T=1/(1-\Delta L) \tag{2}$$

For example, when the brightness variation ΔL is set to 10% (0.1) in Equation (1), the brightness compensation amount ΔT is set to 110% (1.1) by Equation (2).

Figure 4:
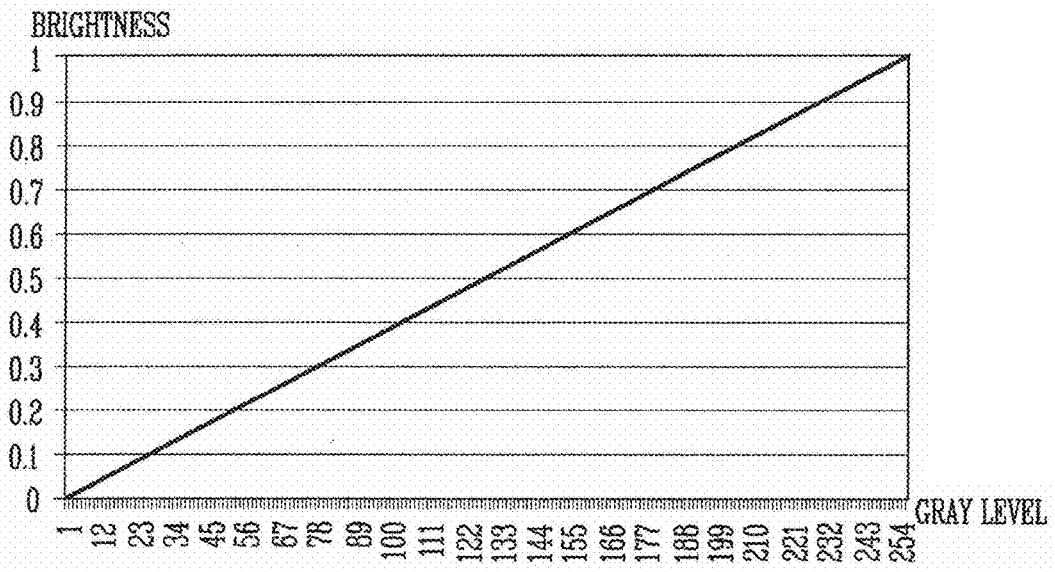
FIG. 4 is a view illustrating a method for compensating for brightness according to a digital driving scheme.

FIG. 4 is a view illustrating a method for compensating for brightness according to a digital driving scheme.

Referring to FIG. 4, in digital driving, brightness is increased according to an increase in a gray level. Thus, the timing controller 150 (or the compensation unit 170) may multiply the brightness compensation amount ΔT by the first data Data1, which is externally input, to generate second data Data2 (i.e., Data2=ΔT×Data1). In this case, the second data Data2 may increase in gray level by the brightness compensation amount ΔT, thus compensating for the degradation of the OLED.

Figure 5:
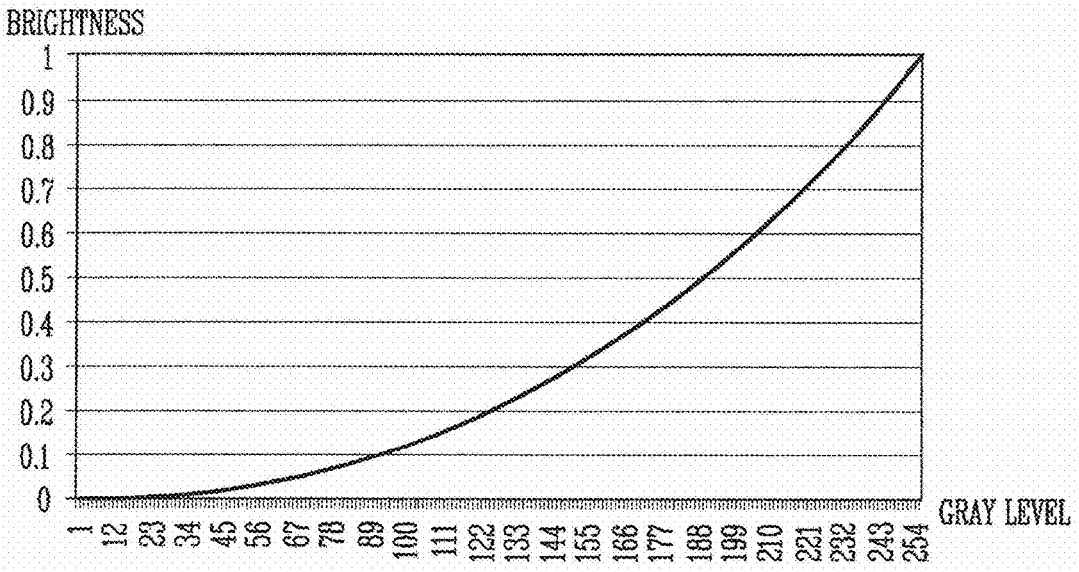
FIG. 5 is a view illustrating a method for compensating for brightness according to an analog driving scheme.

FIG. 5 is a view illustrating a method for compensating brightness according to an analog driving scheme.

Referring to FIG. 5, in analog driving, brightness increases in a curved form (e.g., exponentially) according to an increase in a gray level. That is, in the analog driving, a gamma value is reflected in the data. Thus, the timing controller 150 (or the compensation unit 170) generates second data Data2 in consideration of the brightness compensation amount ΔT, and in consideration of the gamma value with respect to the externally input first data Data1 (Data2=ΔT^(1/gamma)×Data1). In this case, a gray level of the second data Data2 may increase by the brightness compensation amount ΔT in consideration of the gamma, thus compensating for the degradation of the OLED.

Figure 6:
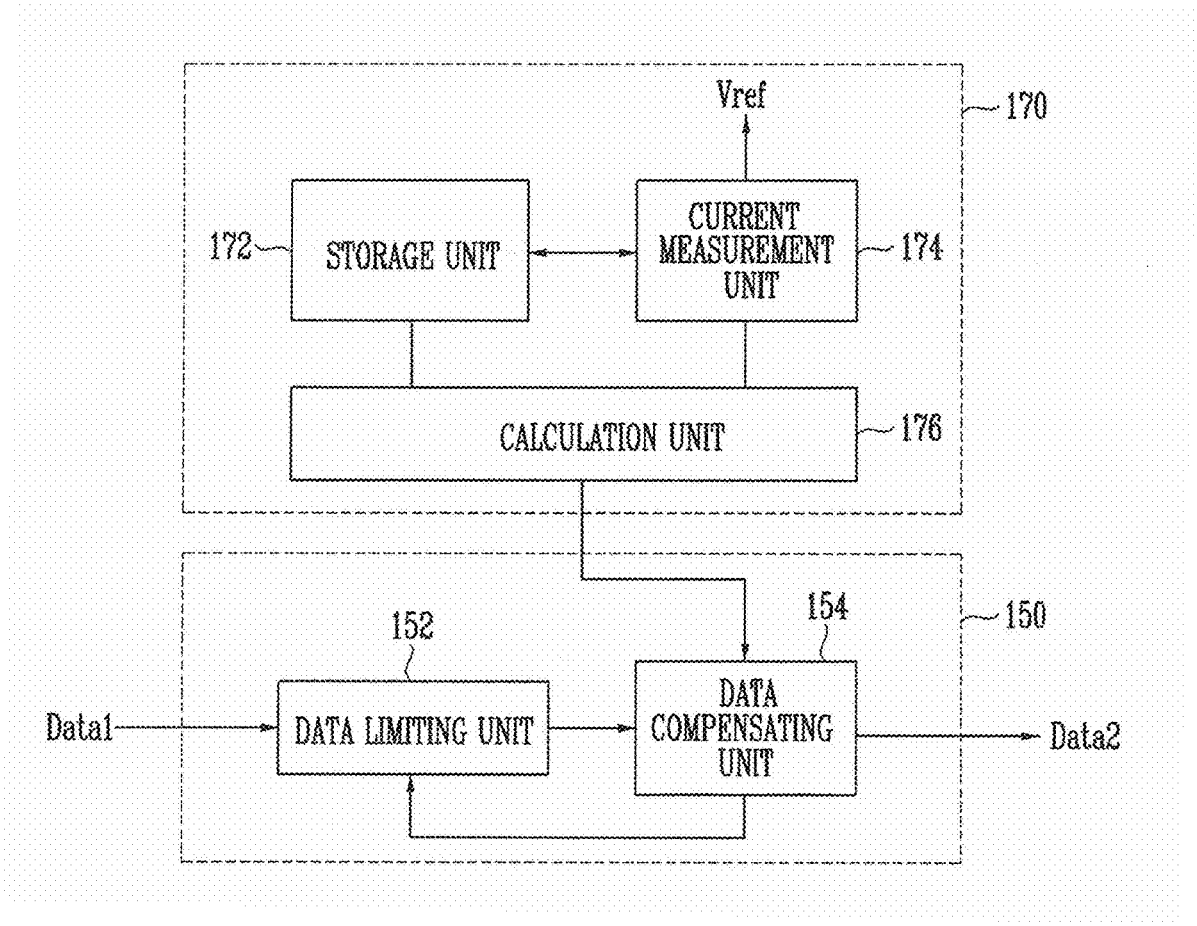
FIG. 6 is a view illustrating an embodiment of a compensation unit and a timing controller illustrated in FIG. 1.

FIG. 6 is a view illustrating an embodiment of the compensation unit and the timing controller illustrated in FIG. 1.

Referring to FIG. 6, the compensation unit 170 according to an embodiment of the present invention includes a storage unit 172, a current measurement unit 174, and a calculation unit 176.

The storage unit 172 stores information required for the calculation unit 176 to perform a calculation. For example, Equation (1), Equation (2), and a reference current value, which corresponds to the reference voltage before the degradation of the OLED, may be stored in the storage unit 172. The brightness compensation amount ΔT obtained by the calculation unit 176 may be stored in the storage unit 172.

The current measurement unit 174 extracts current information of the OLED from the pixels 140. To this end, the current measurement unit 174 supplies the reference voltage Vref to the pixels 140 during a sensing period, and measures a current (e.g., current I) flowing in the OLED of each of the pixels 140 according to the reference voltage Vref. The current measurement unit 174 compares the current I flowing in the OLED with the reference current value, and then obtains a current variation ΔI corresponding to the comparison result. Here, the current variation ΔI of each of the pixels 140 may be changed into a digital value, which may be stored in the storage unit 172.

The calculation unit 176 obtains a brightness variation ΔL and a brightness compensation amount ΔT by using the current variation ΔI. Details of the calculation unit 176 will be described hereinafter.

The timing controller 150 includes a data limiting unit 152 and a data compensating unit 154.

The data compensating unit 154 receives the brightness compensation amount ΔT from the calculation unit 176. When the data compensating unit 154 receives the brightness compensation amount ΔT, the data compensating unit 154 changes bits of the first data Data1 to generate second data Data2. Here, the second data Data2 is set such that the degradation information of the OLED included in each of the pixels 140 is compensated.

Meanwhile, the second data Data2 is generated by increasing the bits of the first data Data1. Thus, in response to degradation of the OLED, bits of the second data Data2 may exceed a region that can be represented by gray levels. When the bits of at least one second data Data2 exceeds the region that can be represented by gray levels, the data limiting unit 152 reduces the bits of the first data Data1 (e.g., reduced the bits of the first data Data1 by a predetermined proportion).

When the bits of the first data Data1 are reduced (e.g., by the predetermined proportion of 10%), brightness of the display area 130 is regularly lowered, and thus, uniform brightness may be maintained. Also, the bits of the first data Data1 are reduced, the second data Data2 are positioned in the region that can be represented by gray levels, and thus, the degradation of the OLED may be stably compensated.

Figure 7:
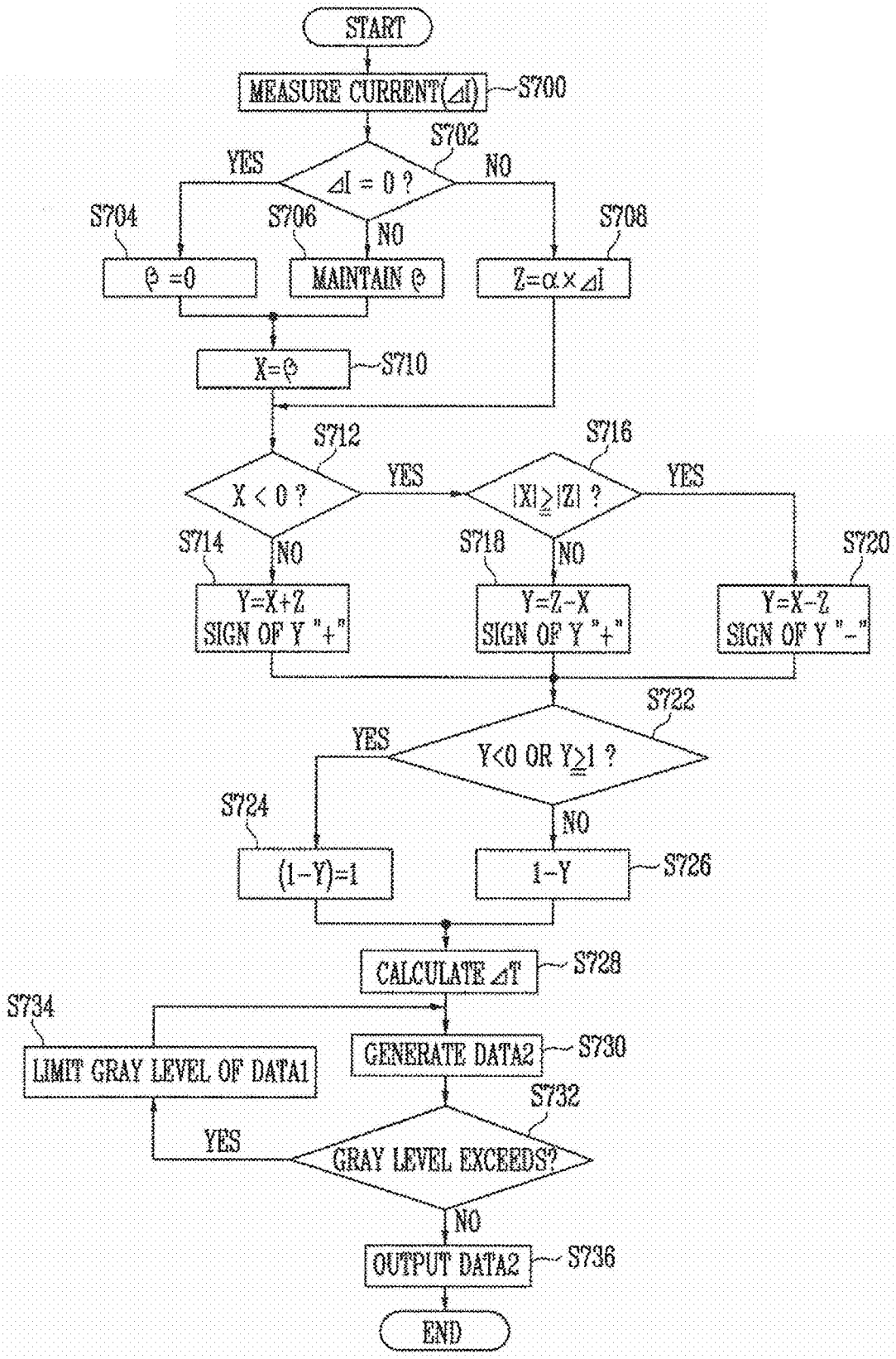
FIG. 7 is a flow chart illustrating a degradation compensation method according to an embodiment.

FIG. 7 is a flow chart illustrating a degradation compensation method according to an embodiment.

<Current (ΔI) Measurement: S700>

At S700, shown at the top of FIG. 7, during the sensing period, the current measurement unit 174 supplies the reference voltage Vref to the OLED included in each of the pixels 140. When the reference voltage Vref is supplied to the OLED, the current I flows in the OLED according to the reference voltage Vref. Thereafter, the current measurement unit 174 compares the current I of the OLED with a reference current value to determine a current variation ΔI. At operation S700, the current variation ΔI of each of the pixels 140 may be determined and stored in the storage unit 172.

<Error Compensation Prevention: S702, S704>

After the current variations ΔI of the respective pixels 140 are stored in the storage unit 172, the calculation unit 176 checks whether the current variations ΔI are at a value of "0" at operation S702. Here, when the current variation ΔI is "0," then the OLED included in the corresponding pixel 140 has not been degraded. Thus, When the current variation ΔI is "0" at operation S702, the calculation unit 176 sets the constant "β" of the linear function to "0" at operation S704.

In detail, when a specific pixel 140 in which the current variation ΔI is determined to be "0" at operation S702, an OLED thereof is determined to have not been degraded, and thus, there is no need to compensate for a degradation of the OLED. However, bits of data to be supplied to the specific pixel 140 may be changed by the constant "β" of Equation (1).

For example, when the constant "β" has a value "0.01", the brightness compensation amount ΔT is set to 1.01 by Equation (1) and Equation (2), and when the constant "β" has a value "−0.01", the brightness compensation amount ΔT is set to 0.99 by Equation (1) and Equation (2). Thus, in the present invention, to prevent a compensation error, when the current variation ΔI is set to "0", the constant "β" is set to "0."

<Calculation of Brightness Variation (ΔL): S702 to S726>

When the current variation ΔI is not determined to be equal to "0" at operation S702, the calculation unit 176 maintains the constant "β" as the original value at operation S706. The calculation unit 176 then also obtains a value of α×ΔI by Equation (1) at operation S708. Thereafter, for the purposes of description, it is assumed that the resultant value of α×ΔI is equal to "Z," and that the constant "β" is equal to "X" at operation S710.

Thereafter, the calculation unit 176 checks whether a value of "X" is less than "0" at operation S712. When the value of "X" is determined to be greater than "0" at operation S712, the calculation unit 176 calculates "Y=X+Z" by Equation (1), and sets a sign of Y to "+" at operation S714.

When the value of "X" is determined to be less than "0" at operation S712, the calculation unit 176 determines whether an absolute value of "X" is equal to or greater than that an absolute value of "Z" at operation S716. When it is determined that the absolute value of "X" is less than the absolute value of "Z", the calculation unit 176 calculates "Y=Z−X" and sets the sign of Y to "+" at operation S718. When it is determined that the absolute value of "X" is equal to or greater than that of "Z", the calculation unit 176 calculates "Y=X−Z" and sets the sign of Y to "−" at operation S720.

Meanwhile, steps S712 to S720 described above are a method for calculating Equation (1), and it should be noted that the present invention is not limited thereto. In practice, other embodiments of the present invention may have various calculation methods to obtain the brightness variation ($\Delta L=Y$) by Equation (1).

After the value "Y" is obtained at operations S714, S718, and S720, the calculation unit 176 determines whether "Y" is smaller than "0" or equal to or greater than "1" at operation S722. When it is determined that "Y" is smaller than "0" or equal to or greater than "1" at operation S722, the calculation unit 176 sets the brightness compensation amount $\Delta T$ to "1" at operations S724 and S728.

In detail, when "Y" is less than "0" (i.e., when the sign of Y is "–"), it means that the absolute value of "X" is equal to or greater than that of "Z." Here, when the absolute value of "X" is greater than that of "Z", it means that the OLED has rarely, or only slightly, degraded. Thus, when "Y" is less than "0", inverse compensation may occur in a pixel, and thus, the brightness compensation amount $\Delta T$ is set to "1."

Also, when "Y" is equal to or greater than "1", the brightness compensation amount $\Delta T$ is set to "–". Thus, when "Y" is equal to or greater than "1," the brightness compensation amount $\Delta T$ is set to "1."

When "Y" is between "0" and "1" at operation S722, the brightness compensation amount $\Delta T$ is obtained by a calculation formula at operations S724, S726, and S728.

The brightness compensation amount $\Delta T$ obtained at operation S728 is stored in the storage unit 172. Here, the brightness compensation amount $\Delta T$ may be stored with respect to each pixel 140, or may be stored with respect to blocks of pixels, each block including two or more pixels 140. For example, with respect to blocks of pixels, the calculation unit 176 may obtain the brightness compensation amount $\Delta T$ (e.g., of two or more adjacent pixels), may average the brightness compensation amount $\Delta T$ included in the two or more pixels 140, and may store the averaged brightness compensation amount $\Delta T$ in units of blocks.

After the brightness compensation amount $\Delta T$ is calculated at operation S728, the data compensating unit 154 changes bits of the first data Data1 using the brightness compensation amount $\Delta T$ to generate second data Data2 at operation S730. The second data Data2 generated by the data compensating unit 154 is transmitted to the data driver 120, and the data driver 120 generates a data signal using the second data Data2 at operation S736. Here, the second data Data2 is determined to compensate for degradation of the OLED included in each of the pixels 140.

In addition, when the bits of the second data Data2 correspond to a value that exceeds a region that may be expressed by gray levels, the data limiting unit 152 reduces the bits of the first data Data1 by a corresponding proportion at operations S732 and S734. Then, the bits may be set to a range that may correctly represent the intended gray levels of the second data Data2 generated by the first data Data1, and thus, a degradation of the OLED may be stably compensated.

Figure 8:
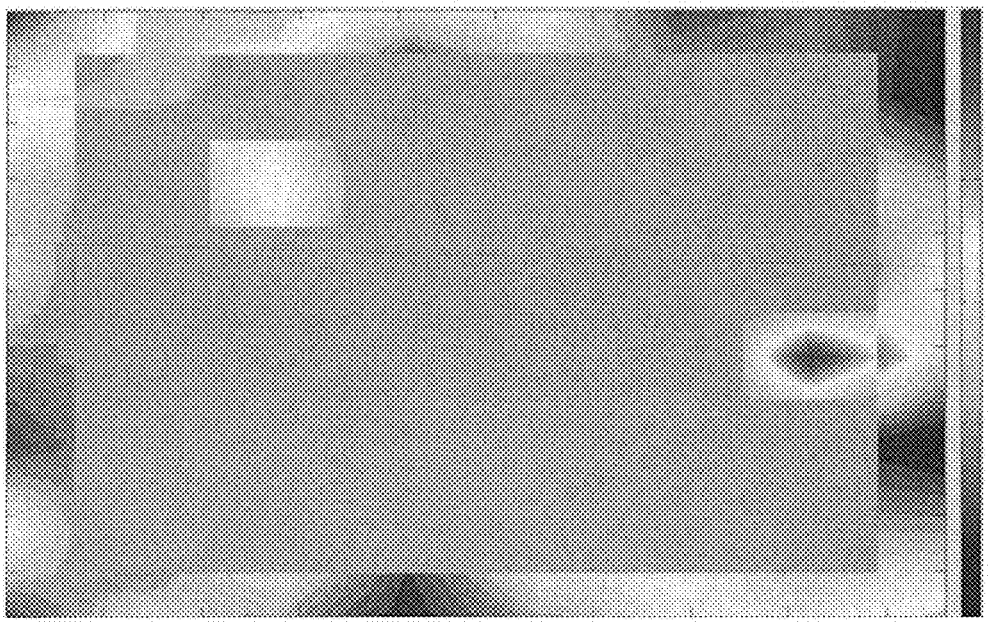
FIG. 8 is a view illustrating a case in which an error is compensated by a value of β.

FIG. 8 is a view illustrating a case in which an error is compensated by according to a value of $\beta$.

Referring to FIG. 8, when the current variation $\Delta I$ is "0," the value of $\beta$ should be set to "0." In practice, when the edge of the display area 130 is not degraded, degradation compensation should not be performed. However, degradation compensation is performed according to the value $\beta$, and thus, a non-uniform image is displayed in the edge region of the display area 130. Thus, in the present embodiment, when the current variation $\Delta I$ is "0," the value of $\beta$ is set to "0." Then, as illustrated in FIG. 9, degradation compensation is not performed in the edge of the display area 130, which has not been degraded, and thus, a uniform image may be displayed.

Figure 9:
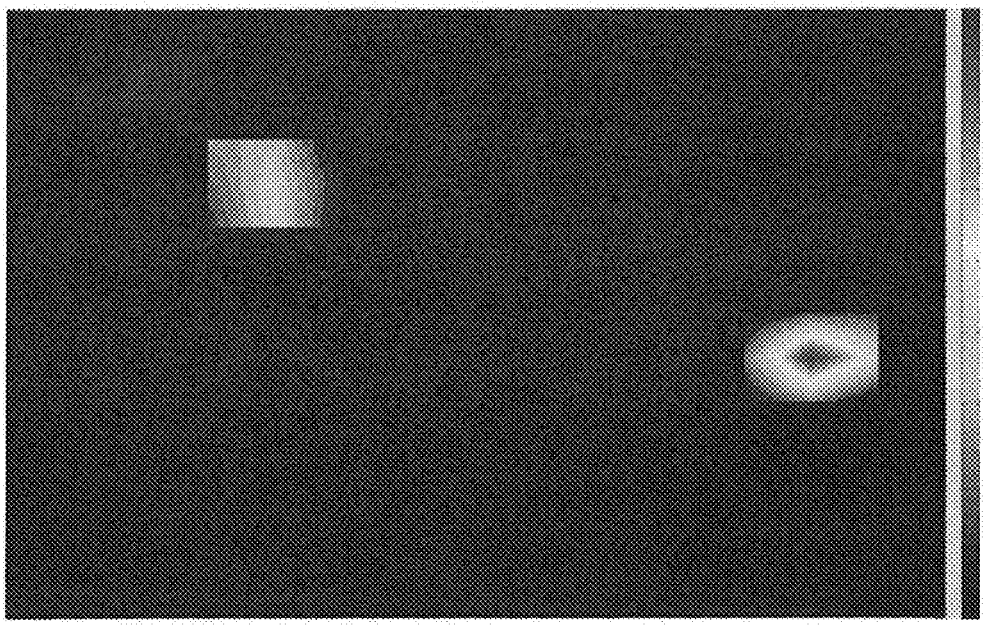
FIG. 9 is a view illustrating a case in which a degradation is compensated in a region in which a degradation is rarely generated.
Figures 10, 11:
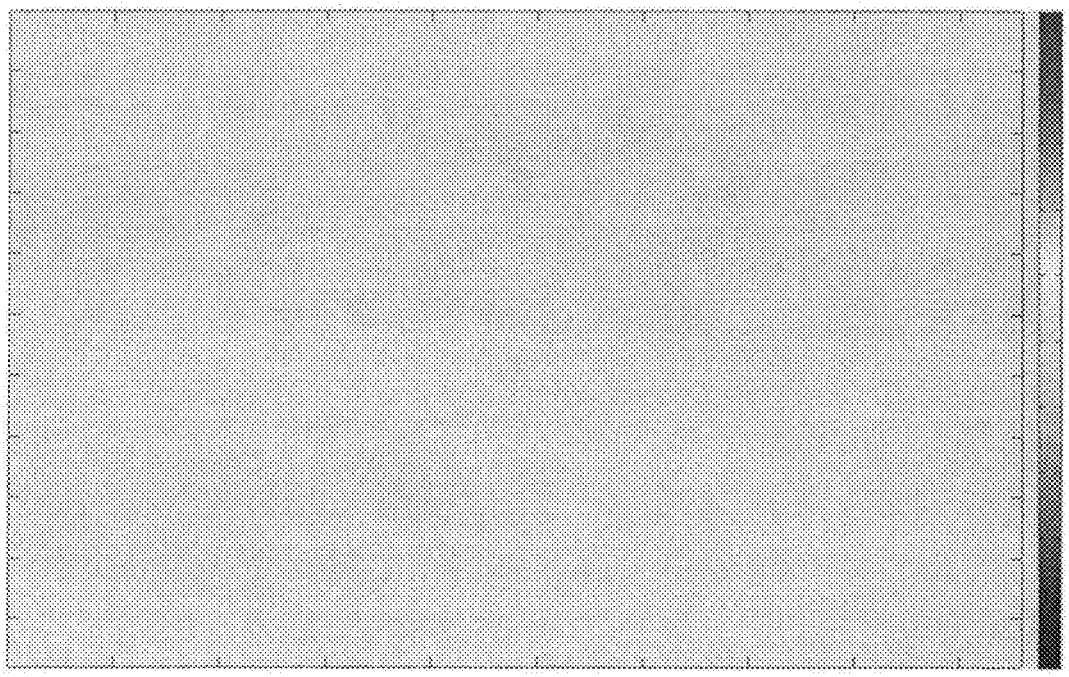
FIG. 10 is a view illustrating a degradation distribution by blocks in which a degradation of FIG. 9 is compensated.
FIG. 11 is a view illustrating a screen of a display area in which a degradation has been compensated by the degradation compensation method of FIG. 7.

In addition, the screen of FIG. 9 illustrates a case in which degradation compensation is performed by blocks. Here, in a block in which degradation occurs rarely, for example, in an area in which degradation has occurred only by 0.1% or 0.4%, unnecessary degradation compensation may occur, as illustrated in FIG. 9. Thus, in the present invention, as described in step S722, when "Y" is smaller than "0" or when Y is greater than "1," the brightness compensation amount $\Delta T$ is set to "1." Then, as illustrated in FIG. 11, an image having uniform brightness may be displayed in the display area 130.

In addition, in embodiments of the present invention, although the transistors are illustrated as PMOSs for the purposes of description, the present invention is not limited thereto. In other words, the transistors may be formed as NMOSs.

Also, in embodiments of the present invention, although the OLED generates red, green, and/or blue light in response to an amount of current supplied from the driving transistor, the present invention is not limited thereto. For example, the OLED may generate white light in response to an amount of current supplied from the driving transistor. In this case, a color image may be implemented by using a color filter, or the like.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. An organic light emitting display device comprising:

a compensation unit configured to extract current information of an organic light emitting diode (OLED) of a pixel by measuring a current flowing in the OLED, and configured to determine a brightness compensation amount corresponding to the extracted current information; and a timing controller configured to generate second data by changing bits of externally supplied first data according to the brightness compensation amount, wherein the compensation unit is configured to obtain the brightness compensation amount using a current variation corresponding to a degradation of the OLED, and using a linear function for expressing a linear relationship between a brightness variation of the OLED and the current variation.

2. The organic light emitting display device of claim 1, wherein the linear function corresponds to the equation:

$$\Delta L=\alpha\Delta I+\beta,$$

wherein $\alpha$ and $\beta$ denote respective constant values of the linear function, wherein $\Delta I$ denotes the current variation, and wherein $\Delta L$ denotes the brightness variation.

3. The organic light emitting display device of claim 2, wherein the compensation unit comprises:

a current measurement unit configured to obtain the current variation ΔI;

a storage unit configured to store the linear function and information corresponding to the brightness compensation amount; and a calculation unit configured to obtain the brightness compensation amount.

4. The organic light emitting display device of claim 3, wherein the current measurement unit is further configured to supply a reference voltage to the OLED, and is further configured to obtain the current variation ΔI by comparing an amount of current flowing in the OLED in response to the reference voltage with a reference current value corresponding to when the OLED is not degraded.

5. The organic light emitting display device of claim 3, wherein the calculation unit is further configured to obtain the brightness variation ΔL according to the current variation ΔI, and is further configured to obtain the brightness compensation amount by using the equation:

$$\Delta T=1/(1-\Delta L),$$

wherein ΔT denotes the brightness compensation amount, and wherein ΔL is not equal to 1.

6. The organic light emitting display device of claim 5, wherein the calculation unit is configured to set β to 0 when the current variation ΔI is 0.

7. The organic light emitting display device of claim 5, wherein the calculation unit is configured to set the brightness compensation amount ΔT to 1 when the brightness variation ΔL is less than 0, or when the brightness variation ΔL is greater than 1.

8. The organic light emitting display device of claim 1, wherein the timing controller comprises a data compensating unit configured to generate the second data by multiplying the first data by the brightness compensation amount.

9. The organic light emitting display device of claim 8, wherein the timing controller further comprises a data limiting unit configured to reduce bits of the first data when corresponding bits of the second data exceed an area expressed by gray levels.

10. The organic light emitting display device of claim 8, wherein the data compensating unit is configured to generate the second data by reflecting a gamma value in the brightness compensation amount when the organic light emitting display device is driven according to an analog scheme.

11. A method of driving an organic light emitting display device comprising:

determining a current variation corresponding to a degradation of an organic light emitting diode (OLED) by measuring a current flowing in the OLED;

obtaining a brightness compensation amount of the OLED using a linear function for expressing a linear relationship between a brightness variation of the OLED and the current variation; and generating second data by changing bits of externally supplied first data according to the brightness compensation amount.

12. The method of claim 11, wherein the determining of the current variation comprises:

supplying a reference voltage to the OLED;

measuring a current flowing to the OLED; and determining the current variation by comparing the current with a reference current value, the reference current value corresponding to when the OLED is not degraded.

13. The method of claim 11, wherein the linear function corresponds to the equation:

$$\Delta L=\alpha\Delta I+\beta$$

wherein α and β denote respective constant values of the linear function, wherein ΔI denotes the current variation, and wherein ΔL denotes the brightness variation.

14. The method of claim 13, wherein the brightness compensation amount corresponds to the equation:

$$\Delta T=1/(1-\Delta L)$$

wherein ΔT denotes the brightness compensation amount, and wherein ΔL is not equal to 1.

15. The method of claim 14, further comprising setting β to 0 when the current variation ΔI is set to 0.

16. The method of claim 14, further comprising setting the brightness compensation amount ΔT to 1 when the brightness variation ΔL is less than 0 or when the brightness variation ΔL is greater than 1.

17. The method of claim 11, further comprising generating the second data by multiplying the first data by the brightness compensation amount.

18. The method of claim 17, further comprising generating the second data by additionally reflecting a gamma value in the brightness compensation amount when the organic light emitting display device is driven according to an analog scheme.

19. The method of claim 11, further comprising reducing bits of the first data when corresponding bits of the second data exceed an area represented by gray levels.

* * * * *